US008322950B2

(12) United States Patent
Craig et al.

(10) Patent No.: US 8,322,950 B2
(45) Date of Patent: Dec. 4, 2012

(54) CABLE BOLT

(75) Inventors: Peter Harold Craig, Cooyal (AU); Timothy Joseph Gaudry, Picton (AU); John Naylor, Yukan (AU)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 641 days.

(21) Appl. No.: 12/039,228

(22) Filed: Feb. 28, 2008

(65) Prior Publication Data

US 2008/0247828 A1 Oct. 9, 2008

(30) Foreign Application Priority Data

Feb. 28, 2007 (AU) ..... 2007901048

(51) Int. Cl.
*E21D 20/02* (2006.01)

(52) U.S. Cl. ..... 405/259.5; 411/82.1

(58) Field of Classification Search ..... 411/4, 5, 411/14.5, 82, 916, 392, 82.1, 82.3, 432, 433, 411/917, 354, 35, 265; 405/259.1, 259.4, 405/259.5, 259.6

See application file for complete search history.

(56) References Cited

U.S. PATENT DOCUMENTS

| | | | | |
|---|---|---|---|---|
| 4,664,555 | A * | 5/1987 | Herbst | 405/259.5 |
| 5,259,703 | A * | 11/1993 | Gillespie | 405/259.6 |
| 5,458,442 | A * | 10/1995 | Ashmore | 405/302.2 |
| 6,428,243 | B1 * | 8/2002 | Hutchins | 405/259.1 |
| 6,779,950 | B1 * | 8/2004 | Hutchins | 405/259.1 |
| 2006/0153645 | A1 * | 7/2006 | Rataj et al. | 405/259.5 |

FOREIGN PATENT DOCUMENTS

| | | | |
|---|---|---|---|
| JP | 56153017 | A * | 11/1981 |
| JP | 01278615 | A * | 11/1989 |
| JP | 02049816 | A * | 2/1990 |
| JP | 02272181 | A * | 11/1990 |

* cited by examiner

*Primary Examiner* — Sunil Singh
(74) *Attorney, Agent, or Firm* — The Webb Law Firm

(57) ABSTRACT

A cable bolt (10, 60) comprising a flexible cable (11) formed from a plurality of wound strands, wherein at least one of the strands is a hollow strand (12*b*). In one form, at least one region (14) of the hollow strand is formed with a helical formation or is otherwise arranged to resist radial compression. A cable bolt (60) is also disclosed with a hollow strand (12*b*) that has a coupling (65) fitted at one end (14) and a resin retainer (61) fitted on the other end of the hollow strand.

10 Claims, 7 Drawing Sheets

CABLE BOLT

BACKGROUND OF THE INVENTION

1. Field of the Invention

The present invention relates to tensionable cable bolts for use in strata support and has been developed especially, but not exclusively for cable bolts that are resin anchored prior to tensioning, tensioned, then post grouted with cement. However, it will be appreciated that the invention is not limited to this particular field of use and may also be applicable to other applications where improved strata support is desirable.

2. Description of Related Art

Roof and wall support is vital in mining and tunneling operations. Mine and tunnel walls and roofs consist of rock strata, which must be reinforced to prevent the possibility of collapse. Rock bolts, such as rigid shaft rock bolts and flexible cable bolts are widely used for consolidating the rock strata.

Known methods for reinforcing rock faces include the use of tensionable cable bolts that are configured to allow post tensioning grouting of the cable into a rock bore hole. These cable bolts are usually made from a plurality of steel filaments wound together to form a tendon. These tendons may also have a number of uniformly sized deformations in the form of, for example, "bulbs", "cages", "buttons" (sleeves), "swages" (rings or barrels that lock onto the cable using tapered cable gripping wedge elements) or other deformations along the length of the cable to provide improved anchorage and load transfer between the cable and the resin or cement grout and the strata. Bulbs and cages are formed by deforming at least some of the cable filaments so that they extend radially outwardly from the rest of the cable periphery. Buttons (sleeves) and swages are respectively crimped on and pressed on to the plain cable.

To facilitate post grouting of these types of cables, the bore holes must be oversized to thereby enable a breather tube and/or a grout tube to be inserted into the hole alongside the bolt and to allow the grout to flow freely into the bore. However, prior to installing the cement grout, the cable bolt is first point anchored with resin at the distal end of the bore.

In one form, point anchoring is achieved by locating a resin cartridge(s) in the closed end of the bore and then inserting and rotating the cable bolt to burst the resin cartridge(s) and mix its contents after which the mixed resin is allowed to cure. In another form, the cable bolt is pointed anchored by a mechanical anchor that expands in the bore. In yet a further form, the point anchoring may be a combination of chemical and mechanical fixing.

Once the resin is sufficiently set, the bolt is tensioned and cement grout can then be inserted, as required, in the remainder of the bore. Typically this is done by either inserting a grout tube along side the cable to a location just below the point anchor so the grout enters from the top and displaces the air in the bore, or alternatively by filling from the end by inserting grout from adjacent the bore opening and displacing the air in the bore via a breather tube that has an opening just below the point anchor. In some prior art cable bolts, the grout or breather tube is positioned centrally in the cable bolt. In either case, care must be taken to ensure the grout tube is not pinched, impeding flow therethrough of either air or grout.

SUMMARY OF THE INVENTION

According to a first aspect there is provided a cable bolt that extends along an axis between opposite ends, the cable bolt comprising:

a flexible cable formed from a plurality of wound co-extending strands, wherein at least one of the strands is a hollow strand comprising at least one region for resisting radial compression.

The at least one region may include reinforcing. In one form, the reinforcing may be in the form of stiffening formations profiled on the hollow strand. The stiffening formations may be annular about the hollow strand's axis. Alternatively, the stiffening formations may comprise one or more helical formations about the hollow strand's axis.

The cable bolt may comprise a plurality of said regions having a respective hinge between adjacent region pairs to facilitate flexibility of the cable. In one arrangement, each hinge may be an annular groove on the outer surface of the hollow strand. In another arrangement, the hinges may comprise spaced apart radially inwardly projecting portions defining spaced apart strand portions therebetween. In one form, each of the radially inwardly projecting portions is an internal shoulder. The shoulders form flexible joints between respective adjacent strand portions.

Alternatively, the hinges may be formed by collars, each of which has an outer diameter less than the outer diameter of the strand portions.

In one form, a first section of the hollow strand has a greater wall thickness than the wall thickness of a second section of the hollow strand adjacent the first section, the first section forming the at least one region. The first section may be at or adjacent a proximal end of the cable. The length of the first section may be less than a quarter of the cable bolt length. Alternatively, the length of the first section may be less than an eighth of the cable bolt length. The first section may be relatively inflexible compared to the remainder of the cable.

The cable bolt may comprise a collar fitting over at least part of the cable comprising the first section. Optionally, the collar fitting may be threaded externally for threaded engagement with a tensioning assembly. The collar fitting may be a swage fitting.

In a further aspect, the invention provides a cable bolt that extends along an axis between opposite ends, the cable bolt comprising:

a flexible cable formed from a plurality of wound co-extending strands, wherein at least one of the strands is a hollow strand including one or more helical formations extending along at least one region of the strand.

The cable bolt may comprise a reinforcing sleeve disposed in or over the cable to increase resistance to axial compression. Alternatively, the at least one region may comprise the reinforcing sleeve. The reinforcing sleeve may be at or adjacent a proximal end of the cable, or it may be in the form of a woven mesh.

The cable bolt may comprise one said hollow strand located axially within the cable. The cable bolt may comprise a plurality of non-hollow strands about the hollow strand.

The incorporation of a cable bolt with a hollow strand allows for the passage of fluid (such as air or grout) which is required in post grouting operations. However, a drawback with a hollow strand, as compared to a solid strand, is that the hollow strand is more susceptible to crushing (i.e. to compress radially). In installation of cable bolts it is typically necessary to tension the cable and this often involves the use of end fittings, such as barrel and wedge assemblies, and/or tensioning equipment, that clamp the cable. The incorporation of a hollow strand that has one or more regions that are helically formed or which are otherwise able to resist radial compression, enables a cable bolt that is still able to have its required flexibility yet can accommodate that application of clamping devices such as those described above to tension the cable bolt.

In one form, the required strength of the region to accommodate radial compression is such that it provides the cable bolt with enough radial strength for a clamping type end fitting to maintain the clamping action onto the cable bolt to then exceed the combined ultimate tensile strength of the cable strands when loaded along the axis of the cable bolt.

In one form, the at least one region is disposed along the length of the hollow strand. In an alternative form, the at least one region is disposed along only a part of the length of the hollow strand, In one form, that part is disposed adjacent a proximal end of the cable. In one form, the length of the part is less than a quarter of the cable bolt length. In one form, the length of the part is less than an eighth of the cable bolt length. In one form, the part is relatively inflexible compared to the remainder of the cable.

In one form, the cable bolt further comprises a tensioning assembly comprising an end fitting mounted on the cable over a said region of the hollow strand, the end fitting being able to be repositioned along the cable and is arranged in use to clamp the cable so as induce radial compression on the cable.

In one form, the end fitting is mounted adjacent a proximal end of the cable.

In a particular form, the end fitting comprises a barrel and wedge assembly having a plurality of wedges being directly mountable to the cable bolt and a barrel being mounted over and receiving the wedges therein. In an alternative form, the end fitting comprises a swage fitting mountable at or near the proximal end of the cable; and a nut threadingly mountable to the swage fitting.

The tensioning assembly may further comprises a bearer plate which is mounted to the cable between the end fitting and the distal end of the cable, wherein the end fitting limits the axial movement of the bearer plate towards the proximal end of the cable bolt.

In yet a further form, a portion of the hollow strand may protrude from a proximal end of the cable, the protruding end having a coupling mounted thereon for receiving a lance to introduce fluid into the hollow strand.

In a further aspect of the invention, there is provided a cable bolt that extends along an axis between opposite ends, the cable bolt comprising a flexible cable formed from a plurality of wound co-extending strands, wherein one of the strands is a hollow strand having a coupling mounted thereon for receiving a lance to introduce fluid into the hollow strand.

In a particular embodiment, a portion of the hollow strand protrudes from a proximal end of the cable, and the coupling is threadingly engaged with the protruding end, the protruding end comprising a threaded outer surface and the coupling has a complementary internal thread.

In a particular form, the coupling has a diameter that is less than the outer diameter of the proximal end of the cable bolt. This feature has particular benefit as it allows a tensioning assembly (such as a hydraulic tensioning assembly) to be mounted over the end of the cable bolt and to grip and tension the cable strands at the proximal end portion of the bolt without gripping the coupling.

In a particular form, the coupling includes a plurality of bayonet fitting slots arranged to receive respective locking pins disposed on the lance, the slots having a return portion at an end thereof in which the locking pins locate, the returns being configured to prevent inadvertent release of the lance from the coupling when the fluid is introduced into the hollow strand from the lance under pressure. In one form, the coupling also acts as a drive head for the cable bolt to allow rotation to be imparted to the cable bolt.

In one form, the cable bolt has a first distal portion adapted primarily for resin point anchoring, and a second proximal portion adapted predominantly for cement grouting. In one form, the first portion includes one or more radially outwardly extending resin mixing protrusions.

In one form, the cable bolt further comprises a resin retainer affixed to the cable between the first portion and said the portion and having a radially outwardly extending head arranged to substantially reduce the migration of resin from the first portion to the second portion within the bore.

In one form, the resin retainer head is arranged to maintain the cable strands in spaced relation from one another to form a bulb in the cable.

In a particular form, the hollow strand extends within the proximal portion and has a distal end that is disposed proximally of the retainer. In a particular form, the resin retainer includes a sleeve the extends from the head and is located over the distal end of the hollow strand, the sleeve including one or more lateral openings and being adapted to direct air or grout from the hollow strand distal end to flow in a radial direction.

In yet a further aspect, there is provided a cable bolt that extends along an axis between opposite ends, the cable bolt comprising a flexible cable formed from a plurality of wound co-extending strands, wherein one of the strands is a hollow strand, a first distal portion of the cable being adapted primarily for resin point anchoring, and a second proximal portion adapted predominantly for cement grouting, a resin retainer affixed to the cable between the first portion and the second portion and having a radially outwardly extending head arranged to substantially reduce the migration of resin from the first portion to the second portion within the bore, the hollow strand extending within the proximal portion and has a distal end that is disposed proximally of the retainer, wherein the retainer further comprises a sleeve the extends from the head and is located over the distal end of the hollow strand, the sleeve including one or more lateral openings so that air or grout from the hollow strand distal end is directed to flow in a radial direction.

The hollow strand may be formed from a polymeric material. Alternatively, the hollow strand may be formed from a metallic material.

The inner diameter of the hollow strand may be in the range of 9 mm-15 mm.

The wall thickness of the hollow strand may be in the range of 0.5 mm to 8 mm; or 0.5 mm to 3 mm.

The flexible cable may be configured to be coiled without kinking the hollow strand wherein the cable coil has a minimum diameter in the range of 0.8 m to 2.5 m; 1 m to 2 m; or no greater than 1.5 m.

According to another aspect there is provided a method of forming a cable bolt comprising the steps of:

co-forming a length of cable comprising a central hollow strand and a plurality of co-extending strands wound about the hollow strand;

reeling the length of cable; and obtaining a predetermined sub-length of cable from the length of cable.

The obtained sub-length of cable may be cut from the length of cable.

The method may further comprise the step, after the obtaining step, of partially unwinding a portion of the co-extending strands and removing a portion of the central hollow strand from within the unwound co-extending strand portion.

The method may further comprise the step, after the unwinding step, of rewinding the co-extending strands portion.

The method may further comprise the step, after the unwinding step, of placing a device, such as nut or resin retainer on a cut end of hollow strand remaining in the cable, the device spacing portions of the co-extending strands at the device from the hollow strand.

BRIEF DESCRIPTION OF THE DRAWINGS

Preferred embodiments of the invention will now be described, by way of example only, with reference to the accompanying drawings where like reference numerals denote like parts and in which.

DETAILED DESCRIPTION OF THE INVENTION

Figure 1:
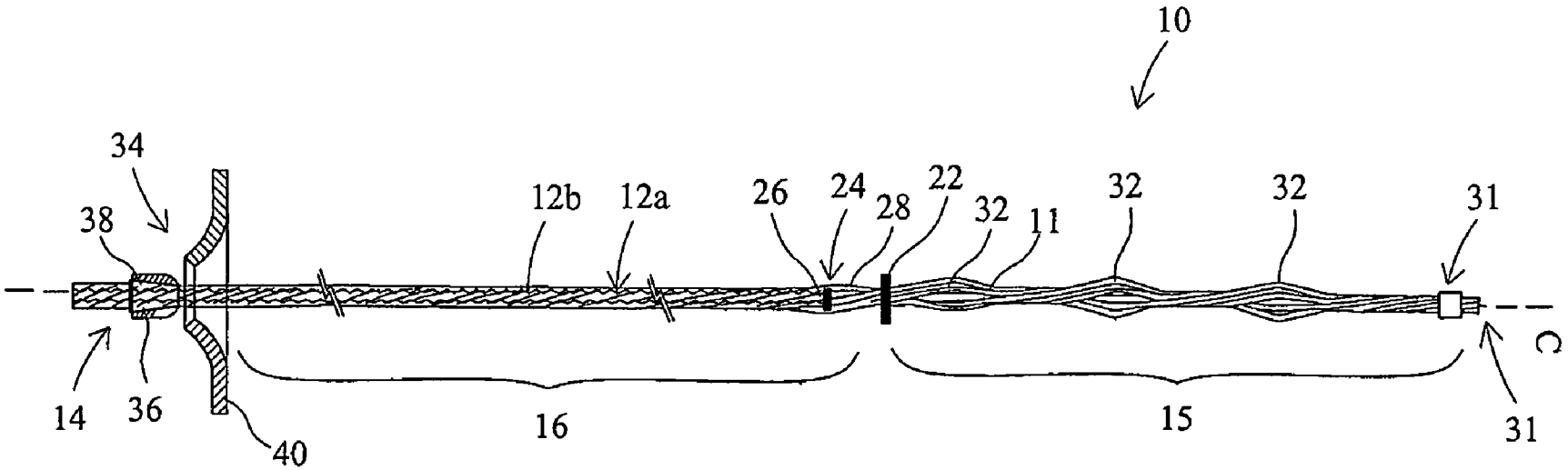
FIG. 1 is a part-sectioned side view of an embodiment of a cable bolt.

As illustrated in FIG. 1, a resin anchorable cable bolt 10 comprises a flexible cable 11 formed from a plurality of wound co-extending strands in the form of wound co-extending steel filaments that extends along an axis C between opposite ends (being, relative to the direction the bolt 10 is installed in a bore in a substrate, such as a mine shaft roof, a distal end 13 and a proximal end 14). The cable 11 has a first portion 15 adapted primarily for resin point anchoring, and a second portion 16 adapted predominantly for cement grouting.

Figure 2:
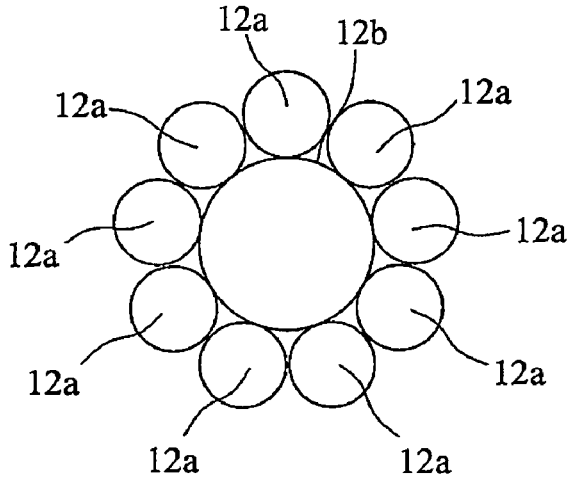
FIG. 2 is a cross-sectional end view of the cable bolt illustrated in FIG. 1, taken on line 2-2.

As illustrated in FIG. 2, the filaments comprise nine outer steel filaments 12*a* spiral wound about a central hollow filament, or strand 12*b*, located axially within the cable 11, the hollow strand 12*b* comprising at least one region for resisting radial compression, in particular of a tensioning assembly which is discussed in more detail below. In alternative arrangements, more or fewer outer steel filaments 12*a* may be used, in which case their relative diameter with respect to the hollow strand 12*b* would be adjusted accordingly such that they are close fitting about the hollow strand 12*b*. The outer steel filaments, or strands, 12*a* are typically solid and of the type used for cable bolt or pre-stressed concrete applications. The hollow strand of the following described embodiments extends in the second portion 16 and not in the first portion 15, however in alternative embodiments, the hollow strand may extend into the first portion 15 also.

In the embodiment of FIG. 1, the central hollow strand 12*b* comprises profiling allowing flexibility of the cable 11, while providing strength to resist crushing of the strand (i.e. radial compression of the cable). The hollow strand 12*b* is flexible to allow coiling of the cable 11 such that the coil has a minimum diameter of 1.2 m without kinking the hollow strand 12*b*. In alternative embodiments, the minimum coiling diameter without kinking the hollow strand may fall within the range of 0.8 m to 2.5 m, or 1 m to 2 m. In the embodiment illustrated in FIG. 1, the profiling is in the form of a helical or spiral ribs 17 along its entire length. The hollow strand 12*b* is formed from a metal material, in this embodiment steel, but may be formed from a polymeric material, such as polypropylene, a polyethylene, or other appropriate polymer.

Figure 3:
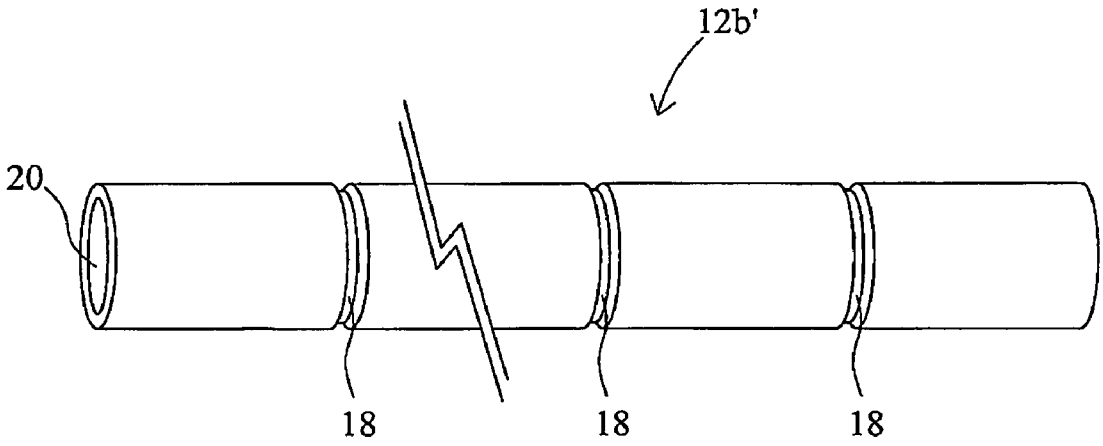
FIG. 3 is a side view of a hollow strand for use with the embodiment of the cable bolt illustrated in FIG. 1.

FIG. 3 illustrates an alternative embodiment of the hollow strand 12*b*', in which the reinforced hollow strand 12*b*' comprises hinges 18. The hollow strand of this embodiment can be used in place of the above hollow strand embodiment described with reference to FIG. 1. The hinges 18 are defined by regions of relatively thinner wall thickness compared to a plurality of spaced apart reinforced hollow strand sections 19 defined by the spaced apart hinges 18. The hollow strand 12*b*' in this embodiment maintains a cylindrical inner surface 20. In practice, the hinges 18 are cut into a reinforced cylindrical pipe to provide an improved degree of flexibility to allow the aforementioned coiling of the cable bolt 11 without kinking. The strand sections are reinforced in that their wall thickness is sufficient to withstand axial compression as mentioned above. In variations of this embodiment, the hinges are cut internally of the hollow strand, maintaining a cylindrical outer surface of the hollow strand, or the hinge is a step between the reinforced sections, providing a groove on the outer surface of the hollow portion and a protrusion on the inner surface of the hollow portion, the protrusion relating to the groove.

Referring again to FIG. 1, the cable bolt 10 further comprises a resin retainer 22 and skirt 23 disposed between the first and second portions 15, 16 of the cable 11. The resin retainer 22 is affixed to the cable 11 and extends radially outwardly from the cable so as to substantially reduce the migration of resin from the first portion to the second portion within the bore during point anchoring of the bolt 10. The resin retainer is typically formed from metal, however may be formed from any suitable polymer such as polypropylene or a polyethylene.

Figure 8:
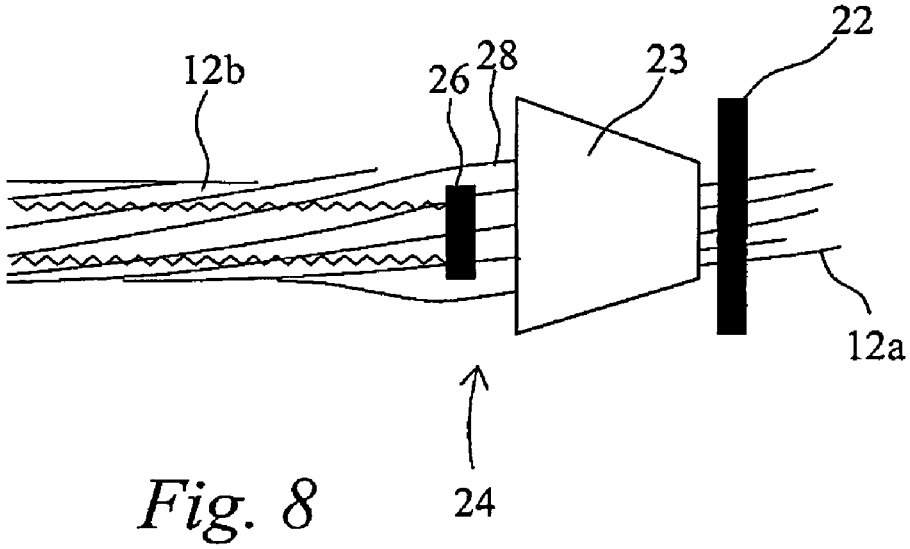
FIGS. 8 and 9 are detailed cross-sectioned side views of alternative embodiments of portions of a cable bolt.
Figure 9:
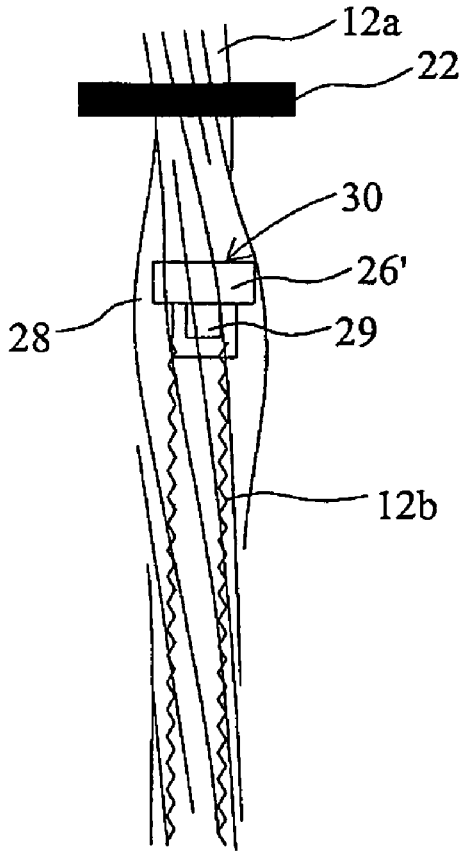
Figure 10:
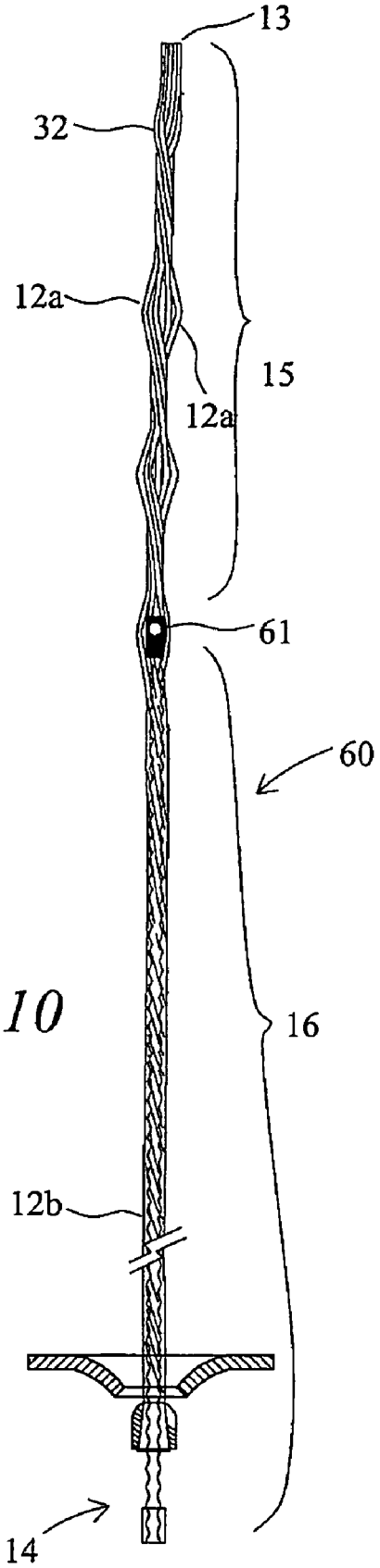
FIG. 10 is a part-sectioned side view of a cable bolt according to a second embodiment.

The hollow strand 12*b* is located in the second portion 16 of the cable bolt 10 and extends from the proximal end 14 of the cable 11 to a location 24 in the second portion 16 at or adjacent the retainer 22. As illustrated in FIG. 1, a nut 26 is located on or near the hollow strand 12*b* at location 24 within the outer filaments 12*a*, forming a bulb, or "nut cage" 28. The nut cage is formed by spacing apart and forcing outwardly all of the steel filaments 12 along a discrete section of the cable 11 and placing the nut 26 about the hollow strand end 24. FIG. 8 illustrates the nut 26 and nut cage 28 in more detail. FIG. 9 illustrates an alternative embodiment of the nut 26' which comprises lateral holes 29 in communication with the hollow strand 12*b*. The end 30 of the nut 26' is solid to block any flow of either resin which may escape about the retainer 22, or of air or grout along the axis of the cable 11 beyond the nut 26' to the retainer 22.

The first portion 15 includes an end collar 31 for holding together the strands 12*a* at the distal end 13, and a plurality (three in the illustrated case) of radially outwardly extending resin mixing protrusions in the form of "bird cages" 32, where a ball bearing is inserted in a partially unwound portion of strands 12*a*. Other types of protrusions may be used.

Figure 4:
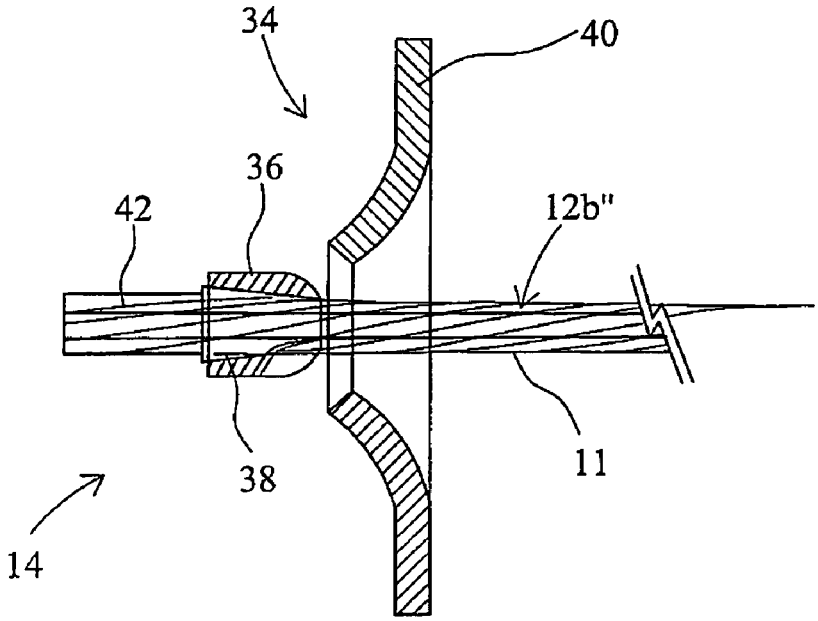
FIGS. 4 to 7 are detailed cross-sectioned side views of an alternative embodiments of a cable bolt.
Figure 5:
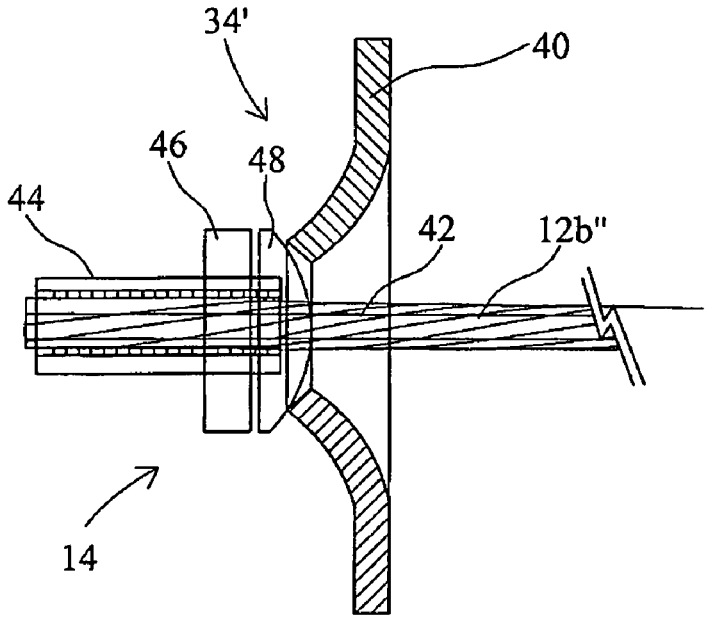

In the embodiment illustrated in FIG. 1, the proximal end 14 comprises a continuation of the outer strands 12*a* woven about the hollow strand 12*b*. FIGS. 4 and 5 illustrate an alternative embodiment of the cable 11 in this regard. In this embodiment, the hollow strand 12*b*" is not profiled but cylindrical and comprises a region for resisting radial compression in the form of a relatively thicker walled hollow strand portion 42 at the proximal end 14. In this regard, the relatively thicker portion 42 is appropriately located adjacent where the tensioning assembly 34 is positioned. In an alternative adaptation of this embodiment, a section of profiled or spiral channeled 17 hollow strand is used in place of the thicker wall portion 42.

Figure 6:
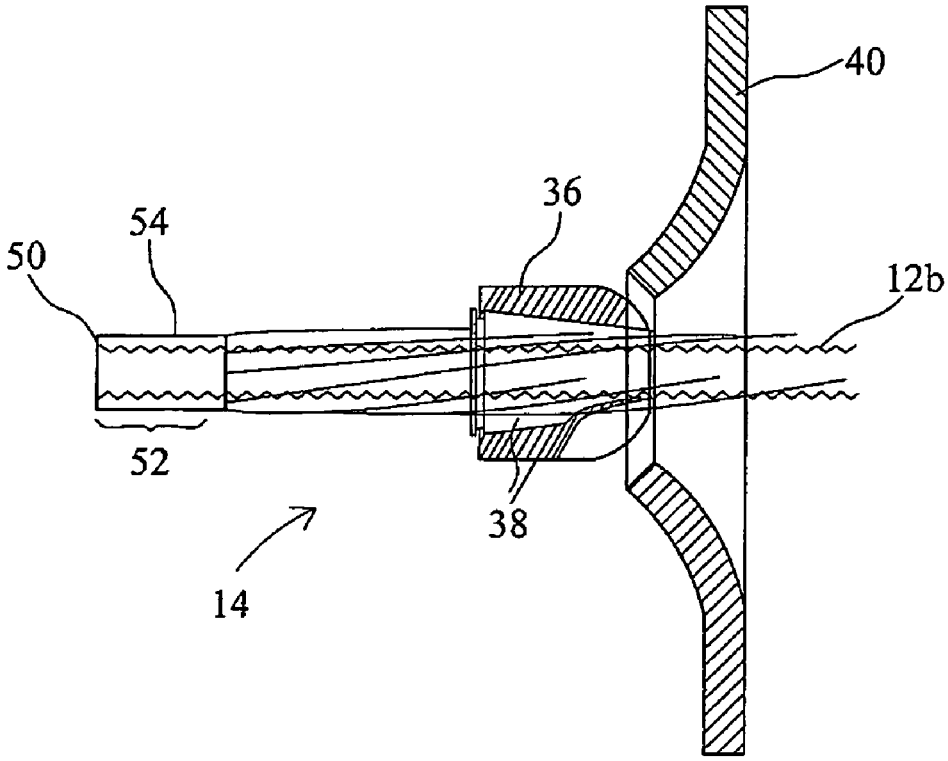

Referring to FIGS. 1, 4 and 6, the tensioning assembly 34 is mountable to the proximal end 14 of the cable 11. The tensioning assembly 34 comprises a clamping device in the form of a barrel 36 and tapered inner wedge 38 which is clamped to the proximal end 14 using known methods, where axial movement of the barrel 36 upon the wedge 38 (in the case of FIG. 1, in the direction of the proximal end 14) causes the wedge 38 to grip more tightly upon the proximal end 14 of the cable 11. It is therefore advantageous to provide the region for resisting radial compression to resist radial compression which may be provided by the wedge 38 on the cable 11. The tensioning assembly 34 further comprises an abutting device in the form of a bearing plate 40 for bearing against a rock surface about the bore, as will be explained below.

FIG. 5 illustrates an alternative embodiment of a tensioning assembly 34' which comprises an externally threaded sleeve 44 fixed about the proximal end 14 of the cable on which is threadedly mounted a nut 46 and on which is slidably mounted a washer 48. The nut is rotatable to force the washer 48 onto the bearing plate 40. In the embodiment of FIG. 5, the same configuration of the proximal end 14 is used as described in relation to FIG. 4. As will be understood, the sleeve 44 may be mounted to the proximal end of any one of the above described embodiments.

Figure 7:
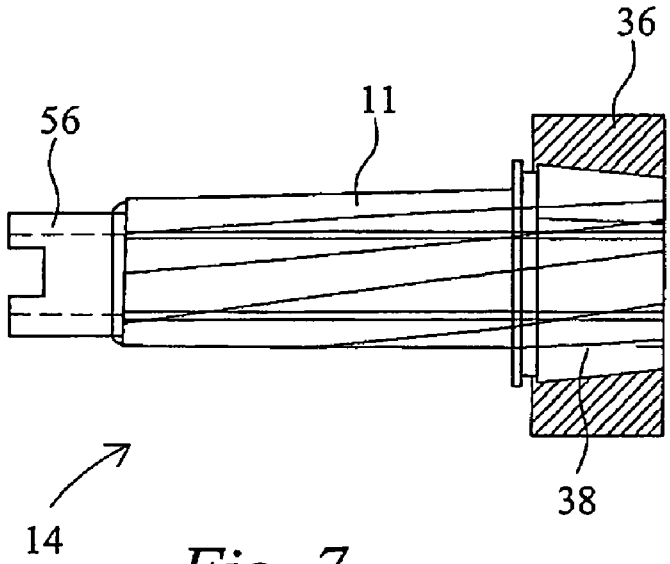

FIGS. 6 and 7 illustrate alternative arrangements for the very end 50 of the proximal end 14 which may be incorporated with any one of the above described embodiments. In FIG. 6, the cable 11 is configured such that the end 52 of the hollow strand 12*b* protrudes from the proximal end 14. The protruding end 52 of the hollow strand 12*b* is configured to have a threaded external surface; in this embodiment the threaded external surface is provided by an end sleeve 54 mounted to the protruding end 52. The mounted sleeve 54 is configured for threaded engagement with a corresponding part of a grout fitting. The grout fitting may be arranged to provide grout within the hollow strand 12*b* or about the hollow strand 12*b* when it is in situ in a bore.

As illustrated in FIG. 7, the proximal end 14 may comprise a drive head in the form of a slot 56. The slot 56 is configured to receive a spanner or the like to rotate the cable bolt for resin mixing, as will be described below.

FIGS. 10 to 16 illustrate a cable bolt 60 according to a further embodiment. As the cable bolt 60 includes many of the features of the cable bolt 10 of the earlier embodiments, like features have been given like reference numerals.

As in the earlier embodiments, the cable bolt 60 comprises a flexible cable 11 formed from a plurality of wound co-extending strands in the form of wound steel filaments that extends along an axis C between opposite ends (being, relative to the direction the bolt 10 is installed in a bore in a substrate, such as a mine shaft roof, a distal end 13 and a proximal end 14). The cable 11 has a first portion 15 adapted primarily for resin point anchoring, and a second portion 16 adapted predominantly for cement grouting. The filaments comprise nine outer steel filaments 12*a* spiral wound about a central hollow filament, or strand 12*b*, located axially within the cable 11. The hollow filament is profiled with a helical rib to give radial strength to the hollow strand whilst still allowing it to be flexible. The hollow strand 126 extends only in the proximal portion and terminates below the resin retainer 61 (which is a modified form to that shown in FIG. 1).

The resin retainer 61 in this embodiment is integrated with a spreader to separate the outer strands 12*a* to form a bulb and includes an end sleeve that locates over the distal end of the hollow strand 12*b* and incorporates the lateral holes 29 to deflect the flow of fluid discharging from the hollow strand 12*b* to flow in a radial direction.

Figure 11:
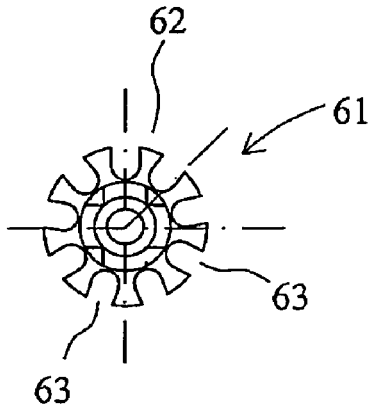
FIG. 11 is a top view of the resin retainer of the cable bolt of FIG. 10.
Figure 12:
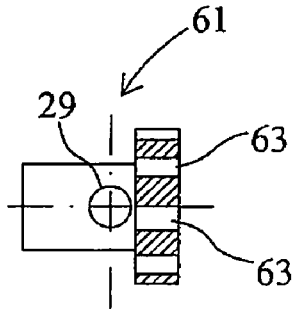
FIG. 12 is a side view of the resin retainer of FIG. 11.
Figure 13:
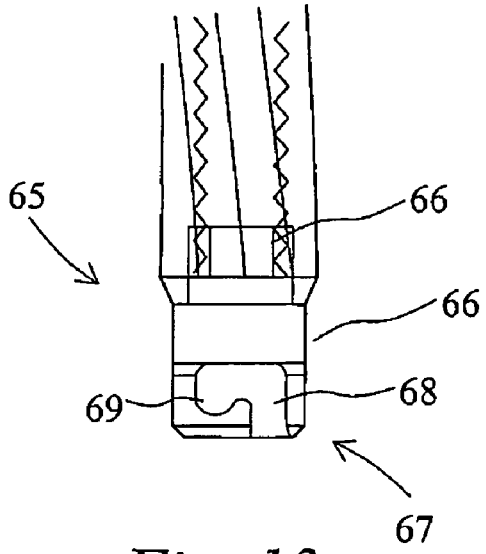
FIG. 13 is a detailed view of the end of the cable bolt of FIG. 10 showing a coupling for a grout lance fixed on that end.

As best shown in FIGS. 11 and 12, the resin retainer includes a head portion 62 that acts as the resin retainer and extends radially to inhibit the migration of resin in an installed bolt from flowing from the first portion 15 to the second portion 16. The head 62 incorporates angularly spaced apart notches 63 each of which is arranged to receive a respective one of the nine outer strands 12*a* to space those strands apart to form a bulb in the cable bolt 60. A sleeve 64 projects down from the head 62 and is designed to fit over, or be threadingly coupled to, the end of the hollow strand 12*b*. The sleeve 64 is closed at one end (where it joins with the head 62) and includes the lateral slots 29 to direct the flow of grout or air from the hollow strand 12*b* to discharge in a radially from strand. In a "bottom up" grouting process where the grout is introduced into the bore, the lateral slots enables the hollow strand to act as a breather tube to vent the air from the bore as it is being filled.

Figure 15:
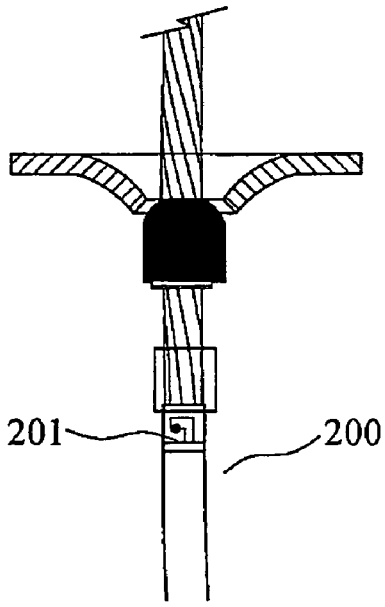
FIG. 15 is a detailed side view of the end of the cable bolt of FIG. 10 connected to a grout lance.

The end 14 of the cable bolt 60 also includes a modified coupling 65 that is arranged to receive a grout lance 200 as shown in FIG. 15. The coupling includes an internally threaded spigot 66 that is threaded onto an end of the hollow strand 12*a*. The threaded coupling allows an adequate seal between the coupling 65 and bolt 60. The coupling 65 may also be fixed in that position by welding or the like so that it does not come loose in use. This also enables coupling to be used to act as a drive head to spin the bolt if need be.

The coupling includes a body 66 that that incorporates a bayonet, fitting 67. The bayonet fitting comprises a pair of slots 68. These slots have a return portion 69 at an end thereof in which the locking pins 201 of the lance 200. These returns 69 are configured to prevent inadvertent release of the lance 200 from the coupling 65 when the fluid is introduced into the hollow strand 12*a* from the lance under pressure.

Figure 14:
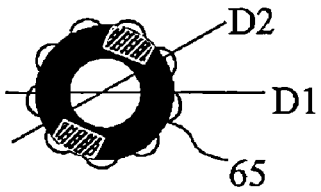
FIG. 14 is an end view of the cable bolt end of FIG. 13.
Figure 16:
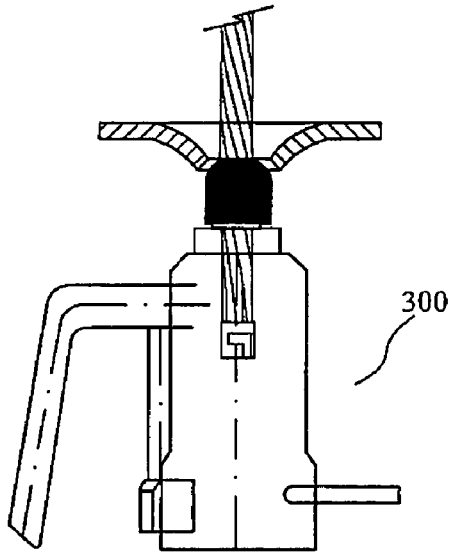
FIG. 16 is a detailed side view of the end of the cable bolt of FIG. 10 connected to a tension assembly.

A feature of the coupling 65 is that it has a diameter $D_1$ that is less that the outer diameter $D_2$ of the cable bolt end (see FIG. 14). This has the advantage that when a tension assembly 300 (such as that shown in FIG. 16) is applied to the cable bolt, the jaws of that assembly do not engage the coupling 65 but rather the outer strands. As loading in the order of 20 t may be applied by the assembly 300 to the cable bolt in tensioning of that bolt, if the assembly engaged the coupling it is likely to break the connection between the coupling 65 and the cable bolt.

The cable bolt 10 is manufactured by co-forming a length of the cable 11 comprising the central hollow strand 12*b* and a plurality of co-extending outer strands 12*a* wound about the hollow strand. In this embodiment, nine strands 12*a* are wound about the hollow strand 12*b*, while in alternative embodiments more or fewer outer strands may be used. The cable is reeled, preferably in lengths of about 800 m for convenience. As will be understood, other lengths may be manufactured. Cable bolts 10 are then formed from the reel of cable by continuously unreeling the cable and cutting sub-lengths of cable to desired lengths. In this embodiment, the desired, or predetermined sub-length of cable is about 8 m, however may be in the range of 2 m to 10 m.

After the sub-lengths are obtained, a portion of the co-extending strands of cut sub-length of cable, about 2 m from the distal end, are partially unwound to reveal the hollow strand 12*b*, which is then cut, forming two lengths of hollow strand. One of those lengths, being the length of about 2 m from the cut to the distal end, is then removed from the cable 11. The end nut 26 is then fixed to the end 24 of the hollow strand, the unwound portion is rewound and the retainer 22 positioned in place on the cable. Three other portions of co-extending cable 12*a* are partially unwound between the retainer 22 and the distal end 13. A nut or similar device is then placed within each partially unwound portion and the partially unwound portions are rewound to provide the nut cages 32.

In use, the bore, typically of constant diameter along its length, is drilled into the rock strata. Resin cartridge(s) are inserted into the bore and are pushed to the closed end of the bore by the subsequent insertion of the cable bolt 10 into the bore. The amount of resin required will depend on the analysis of the rock strata on site. The bore is sized so that the resin mixing protrusions are in close proximity to the wall of the bore.

As a non-limiting example, typical dimensions of the bolt 10 and bore that have been found by the Applicant to work satisfactory are as follows:

| | |
|---|---|
| Bore diameter | 38-42 mm |
| Nominal cable diameter | 26-28 mm |
| Nut cage diameter | 35-40 mm |
| Outer diameter of the resin retainer | 35-40 mm |
| Hollow strand diameter | 12-15 mm |
| Outer strands diameter | 6.0-7.5 mm |

With these dimensions, there can be a 4 mm clearance provided at the three widest points of the cable; being at the resin mixing protrusions, the resin retainer, and the nut cages 32.

The first stage of fixing of the cable bolt 10, 60 in the rock strata is to point anchor the bolt 10. To do this, the cable bolt 10, 60 is further inserted into the bore to be forced into the resin cartridges, and rotated. This combined action causes the cartridge(s) to burst. Further rotation of the bolt allows the resin to mix and the nut cages 32 by being in close proximity to the bore wall ensure that there is effective mixing to cause curing of the resin.

After the cable bolt is point anchored by the resin, it can be tensioned using the tension assembly 34, where the bearing plate 40, via the barrel and wedge, 36,38, is forced onto the rock strata surrounding the bore, which provides tension along the cable 11, resulting in compression on the rock strata surrounding the bore.

In a final stage of fixing the cable bolt to the rock strata, the second portion of the cable bolt is grouted in the bore. By having the end 24 of the tube just below the resin retainer 22, 65 allows the grout to be disposed along the entire length of the second portion thereby maximising the strength of the fixing.

In one process, grout is pumped from the bore opening, and air in the bore is able to escape through the breather tube. A plug (not shown) is typically inserted in the bore opening to keep the grout within the bore until it cures sufficiently.

In another process, grout is introduced in the tube and thereby fills the bore from the distal end 24 of the tube to the proximal end 14 of the bolt.

In the preceding summary and description and in the following claims, it will be understood that the invention and the preferred embodiments are suitable for use in hard rock applications as well as in softer strata, such as that often found in coal mines, and it is to be appreciated that the term "rock" as used in the specification is to be given a broad meaning to cover both these applications.

While the invention has been described in reference to its preferred embodiments, it is to be understood that the words which have been used are words of description rather than limitation and that changes may be made to the invention without departing from its scope as defined by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A cable bolt extends along an axis between opposite ends, the cable bolt comprising:

a flexible cable formed from a plurality of wound strands and a hollow strand, wherein the hollow strand has a coupling mounted thereon for receiving a lance to introduce fluid into the hollow strand, wherein the coupling has a diameter that is less than the outer diameter of a proximal end of the flexible cable, and wherein the coupling includes a plurality of bayonet fitting slots arranged to receive respective locking pins disposed on the lance, the slots having a return portion at an end thereof in which the locking pins locate, the returns being configured to prevent inadvertent release of the lance from the coupling when the fluid is introduced into the hollow strand from the lance under pressure.

2. The cable bolt of claim 1, wherein said hollow strand is located axially within the cable.

3. The cable bolt of claim 2, wherein the plurality of wound strands comprise non-hollow strands positioned about the hollow strand.

4. A cable bolt extends along an axis between opposite ends, the cable bolt comprising:

a flexible cable formed from a plurality of wound strands and a hollow strand, wherein the hollow strand includes one or more helical formations extending along at least one region of the strand, wherein the cable bolt has a first distal portion adapted primarily for resin point anchoring, and a second proximal portion adapted predominantly for cement grouting; and a resin retainer affixed to said cable between said first portion and said second portion and having a radially outwardly extending head arranged to substantially reduce the migration of resin from said first portion to said second portion within the bore, wherein the hollow strand extends within the proximal portion and has a distal end that is disposed proximally of the retainer, the resin retainer includes a sleeve that extends from the head and is located over the distal end of the hollow strand, the sleeve includes one or more lateral openings and is adapted to direct air or grout from the hollow strand distal end to flow in a radial direction.

5. The cable bolt according to claim 4, wherein the resin retainer head is arranged to maintain the cable strands in spaced relation from one another to form a bulb in the cable.

6. The cable bolt of claim 4, wherein the flexible cable is configured to be coiled without kinking the hollow strand wherein the cable coil has a minimum diameter in the range of 0.9 m to 2.5 m.

7. The cable bolt of claim 4, comprising a tensioning assembly comprising an end fitting mounted on the cable ever a said over said region of the hollow strand, the end fitting being able to be repositioned along the cable and is arranged in use to clamp the cable so as to induce radial compression on the cable.

8. The cable bolt of claim 4, wherein a portion of the hollow strand protrudes from a proximal end of the cable, the protruding end having a coupling mounted thereon for receiving a lance to introduce fluid into the hollow strand.

9. A cable bolt extends along an axis between opposite ends, the cable bolt comprising:

a flexible cable formed from a plurality of wound strands and a hollow strand, wherein a first distal portion of the cable is adapted primarily for resin point anchoring, and a second proximal portion is adapted predominantly for cement grouting, a resin retainer affixed to said cable between said first portion and said second portion and having a radially outwardly extending head arranged to substantially reduce the migration of resin from said first portion to said second portion within the bore, the hollow strand extending within the proximal portion and has a distal end that is disposed proximally of the retainer, wherein the retainer further comprises a sleeve that extends from the head and is located over the distal end of the hollow strand, the sleeve including one or more lateral openings so that air or grout from the hollow strand distal end is directed to flow in a radial direction.

10. The cable bolt according to claim 9, wherein the resin retainer head is arranged to maintain the non-central strands in spaced relation from one another to form a bulb in the cable.

* * * * *

UNITED STATES PATENT AND TRADEMARK OFFICE

CERTIFICATE OF CORRECTION

PATENT NO. : 8,322,950 B2
APPLICATION NO. : 12/039228
DATED : December 4, 2012
INVENTOR(S) : Peter Harold Craig et al.

It is certified that error appears in the above-identified patent and that said Letters Patent is hereby corrected as shown below:

Column 11, Lines 6-7, Claim 7, after "cable" delete "ever a said"

Signed and Sealed this
Twenty-ninth Day of January, 2013

David J. Kappos

David J. Kappos
*Director of the United States Patent and Trademark Office*